US009052115B2

(12) United States Patent
Stoia et al.

(10) Patent No.: US 9,052,115 B2
(45) Date of Patent: Jun. 9, 2015

(54) SYSTEM AND METHOD FOR SUPPLYING A WORKING FLUID TO A COMBUSTOR

(75) Inventors: Lucas John Stoia, Taylors, SC (US); Bryan Wesley Romig, Simpsonville, SC (US); Thomas Edward Johnson, Greer, SC (US); Christian Xavier Stevenson, Inman, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 601 days.

(21) Appl. No.: 13/455,480

(22) Filed: Apr. 25, 2012

(65) Prior Publication Data

US 2013/0283807 A1 Oct. 31, 2013

(51) Int. Cl.
*F23R 3/34* (2006.01)

(52) U.S. Cl.
CPC . *F23R 3/346* (2013.01); *F23R 3/34* (2013.01); *F23R 2900/03341* (2013.01)

(58) Field of Classification Search
CPC ..... F23R 3/346; F23R 3/286; F23R 3/26; F23R 3/34
USPC ..... 60/722, 733, 734, 740, 741, 746, 752, 60/754, 785, 795
See application file for complete search history.

(56) References Cited

U.S. PATENT DOCUMENTS

| | | | | |
|---|---|---|---|---|
| 2,922,279 | A | 1/1960 | Roberson et al. | |
| 3,934,409 | A | 1/1976 | Quillevere et al. | |
| 4,040,252 | A | 8/1977 | Mosier et al. | |
| 4,045,956 | A | 9/1977 | Markowski et al. | |
| 4,112,676 | A | 9/1978 | DeCorso | |
| 4,253,301 | A | 3/1981 | Vogt | |
| 4,255,927 | A * | 3/1981 | Johnson et al. | 60/39.23 |
| 4,288,980 | A | 9/1981 | Ernst | |
| 4,574,585 | A * | 3/1986 | Conn | 60/795 |

(Continued)

FOREIGN PATENT DOCUMENTS

| | | |
|---|---|---|
| EP | 2236935 | 6/2010 |
| EP | 2206964 A2 | 7/2010 |

(Continued)

OTHER PUBLICATIONS

Co-pending U.S. Appl. No. 13/417,405, Chen et al., filed Mar. 12, 2012.

(Continued)

*Primary Examiner* — Phutthiwat Wongwian
*Assistant Examiner* — Steven Sutherland
(74) *Attorney, Agent, or Firm* — Dority & Manning, PA

(57) ABSTRACT

A system for supplying a working fluid to a combustor includes a fuel nozzle, a combustion chamber downstream from the fuel nozzle, and a flow sleeve that circumferentially surrounds the combustion chamber. Injectors circumferentially arranged around the flow sleeve provide fluid communication through the flow sleeve and into the combustion chamber. A valve upstream from the injectors has a first position that permits working fluid flow to the injectors and a second position that prevents working fluid flow to the injectors. A method for supplying a working fluid to a combustor includes flowing a working fluid through a combustion chamber, diverting a portion of the working fluid through injectors circumferentially arranged around the combustion chamber, and operating a valve upstream from the injectors to control the working fluid flow through the injectors.

11 Claims, 5 Drawing Sheets

(56) References Cited

U.S. PATENT DOCUMENTS

| | | | | |
|---|---|---|---|---|
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,297,391 | A | 3/1994 | Roche | |
| 5,321,948 | A | 6/1994 | Leonard | |
| 5,351,474 | A * | 10/1994 | Slocum et al. | 60/39.23 |
| 5,450,725 | A | 9/1995 | Takahara et al. | |
| 5,623,819 | A | 4/1997 | Bowker et al. | |
| 5,749,219 | A | 5/1998 | DuBell | |
| 5,974,781 | A | 11/1999 | Correa et al. | |
| 6,047,550 | A | 4/2000 | Beebe | |
| 6,178,737 | B1 | 1/2001 | Lenertz et al. | |
| 6,192,688 | B1 | 2/2001 | Beebe | |
| 6,253,538 | B1 | 7/2001 | Sampath et al. | |
| 6,860,098 | B2 * | 3/2005 | Suenaga et al. | 60/39.23 |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn et al. | |
| 7,500,347 | B2 * | 3/2009 | Sanders et al. | 60/39.23 |
| 7,631,504 | B2 * | 12/2009 | Belsom | 60/772 |
| 7,665,309 | B2 | 2/2010 | Parker et al. | |
| 8,475,160 | B2 | 7/2013 | Campbell et al. | |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2009/0084082 | A1 | 4/2009 | Martin et al. | |
| 2010/0018208 | A1 | 1/2010 | Ritland | |
| 2010/0018209 | A1 | 1/2010 | Ramier et al. | |
| 2010/0174466 | A1 | 7/2010 | Davis, Jr. et al. | |
| 2011/0056206 | A1 | 3/2011 | Wiebe | |
| 2011/0067402 | A1 | 3/2011 | Wiebe et al. | |
| 2011/0131998 | A1 | 6/2011 | Nadkarni et al. | |
| 2011/0179803 | A1 | 7/2011 | Berry et al. | |
| 2011/0296839 | A1 | 12/2011 | Van Nieuwenhuizen et al. | |
| 2013/0008169 | A1 | 1/2013 | Belsom et al. | |

FOREIGN PATENT DOCUMENTS

| | | |
|---|---|---|
| EP | 2613082 | 10/2013 |
| JP | 2006138566 | 6/2006 |
| WO | WO 2004/035187 A2 | 4/2004 |

OTHER PUBLICATIONS

Co-pending U.S. Appl. No. 13/349,886, Stoia, et al., filed Jan. 13, 2012.

Co-pending U.S. Appl. No. 13/344,877, Stoia, et al., filed Jan. 6, 2012.

Co-pending U.S. Appl. No. 13/349,906, Stoia, et al., filed Jan. 13, 2012.

Co-pending U.S. Appl. No. 13/420,715, Chen, et al., filed Mar. 15, 2012.

Co-pending U.S. Appl. No. 13/455,429, Romig, et al., filed Apr. 25, 2012.

Co-pending U.S. Appl. No. 14/122,694, Shershnyov, filed Nov. 27, 2013.

Co-pending U.S. Appl. No. 14/122,697, Shershnyov, filed Nov. 27, 2013.

Co-pending U.S. Appl. No. 13/466,184, Melton, et al. filed May 8, 2012.

EP Search Report and Written Opinion dated Nov. 20, 2013, issued in connection with corresponding EP Patent Application No. 13164858.6.

* cited by examiner

SYSTEM AND METHOD FOR SUPPLYING A WORKING FLUID TO A COMBUSTOR

FIELD OF THE INVENTION

The present invention generally involves a system and method for supplying a working fluid to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more fuel nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various parameters influence the design and operation of combustors. For example, higher combustion gas temperatures generally improve the thermodynamic efficiency of the combustor. However, higher combustion gas temperatures also promote flame holding conditions in which the combustion flame migrates towards the fuel being supplied by the fuel nozzles, possibly causing damage to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more injectors, also known as late lean injectors, may be circumferentially arranged around the combustion chamber downstream from the fuel nozzles. A portion of the compressed working fluid exiting the compressor may be diverted through the injectors to mix with fuel to produce a lean fuel-air mixture. The lean fuel-air mixture may then be injected into the combustion chamber for additional combustion to raise the combustion gas temperature and increase the thermodynamic efficiency of the combustor.

The late lean injectors are effective at increasing combustion gas temperatures without producing a corresponding increase in the production of $NO_X$. However, the diverted compressed working fluid that flows through the injectors necessarily reduces the amount and velocity of compressed working fluid available to flow through the fuel nozzles. Reduced flow and/or velocity of compressed working fluid through the fuel nozzles create conditions more conducive to flame holding conditions in the fuel nozzles. In addition, the reduced amount and velocity of compressed working fluid flowing through the fuel nozzles may impact the ability to operate the combustor using liquid fuel without implementing additional $NO_X$ abatement measures, such as richer fuel-air ratios and/or emulsifying the liquid fuel. Therefore, an improved system and method that can vary the amount of working fluid diverted through the injectors would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor that includes a fuel nozzle, a combustion chamber downstream from the fuel nozzle, and a flow sleeve that circumferentially surrounds the combustion chamber. A plurality of injectors circumferentially arranged around the flow sleeve provide fluid communication through the flow sleeve and into the combustion chamber. A valve upstream from at least one of the plurality of injectors has a first position that permits working fluid flow to the at least one injector and a second position that prevents working fluid flow to the at least one injector.

Another embodiment of the present invention is a system for supplying a working fluid to a combustor that includes a combustion chamber, a liner that circumferentially surrounds the combustion chamber, and a flow sleeve that circumferentially surrounds the liner. A plurality of injectors circumferentially arranged around the flow sleeve provide fluid communication through the flow sleeve and the liner into the combustion chamber. A valve upstream from at least one of the plurality of injectors has a first position that permits working fluid flow to the at least one injector and a second position that prevents working fluid flow to the at least one injector.

The present invention may also include a method for supplying a working fluid to a combustor. The method includes flowing a working fluid from a compressor through a combustion chamber, diverting a portion of the working fluid through a plurality of injectors circumferentially arranged around the combustion chamber, and operating a valve upstream from at least one of the plurality of injectors to control the working fluid flow through the at least one injector.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
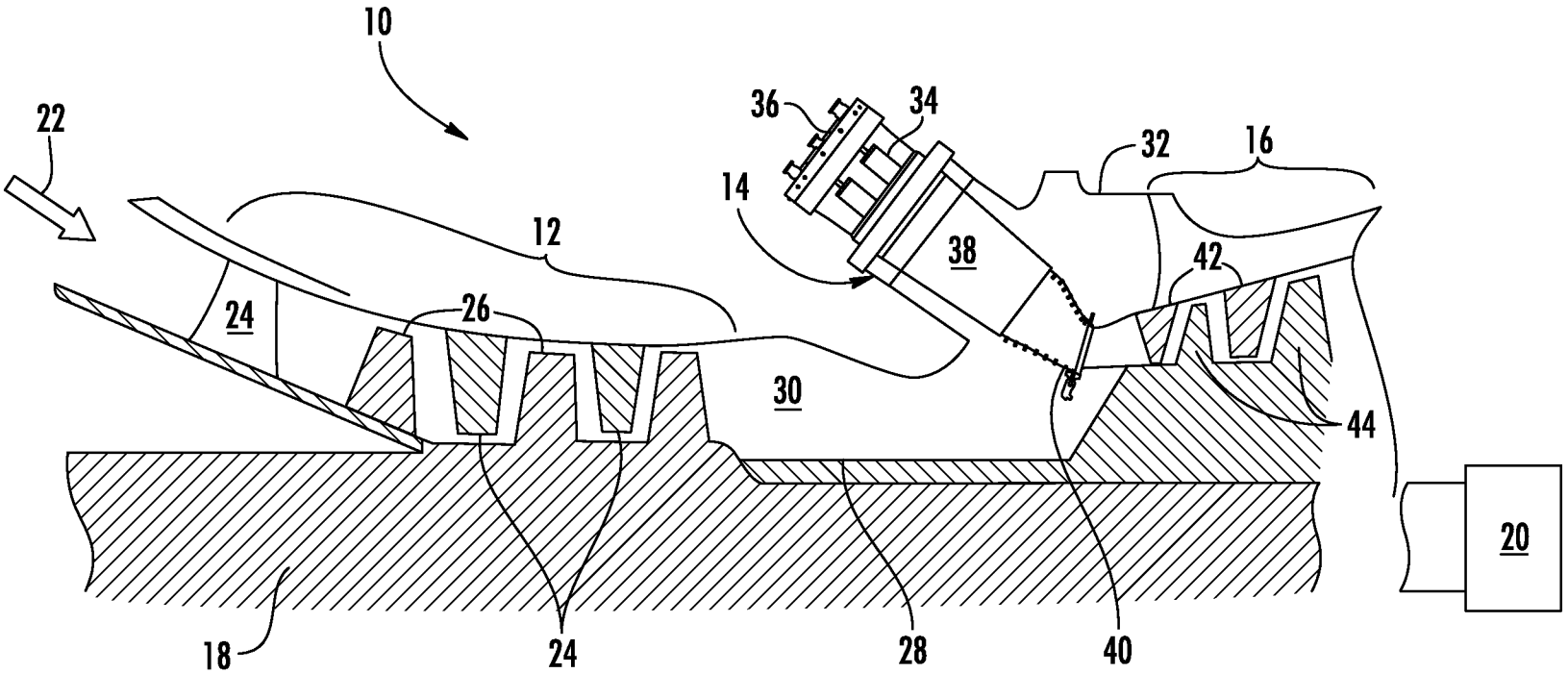
FIG. 1 is a simplified side cross-section view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for supplying a working fluid to a combustor. In general, the system includes multiple late lean injectors that circumferentially surround a combustion chamber. The system diverts or flows a portion of the working fluid through the late lean injectors and into the combustion chamber. A valve upstream from one or more of the late lean injectors controls the amount of working fluid diverted through one or more of the late lean injectors. In particular embodiments, a distribution manifold may circumferentially surround the late lean injectors to reduce variations in the pressure and/or flow rate of the working fluid reaching the late lean injectors, and the valve may control the amount of working fluid diverted into the distribution manifold. As a result, the system and method disclosed herein enable the amount of working fluid diverted through the late lean injectors to be varied as desired to support liquid fuel combustion and/or respond to flame holding conditions in the combustion chamber. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of an exemplary gas turbine 10 that may incorporate various embodiments of the present invention. As shown, the gas turbine 10 may include a compressor 12 at the front, one or more combustors 14 radially disposed around the middle, and a turbine 16 at the rear. The compressor 12 and the turbine 16 typically share a common rotor 18 connected to a generator 20 to produce electricity.

The compressor 12 may be an axial flow compressor in which a working fluid 22, such as ambient air, enters the compressor 12 and passes through alternating stages of stationary vanes 24 and rotating blades 26. A compressor casing 28 contains the working fluid 22 as the stationary vanes 24 and rotating blades 26 accelerate and redirect the working fluid 22 to produce a continuous flow of compressed working fluid 22. The majority of the compressed working fluid 22 flows through a compressor discharge plenum 30 to the combustor 14.

The combustor 14 may be any type of combustor known in the art. For example, as shown in FIG. 1, a combustor casing 32 may circumferentially surround some or all of the combustor 14 to contain the compressed working fluid 22 flowing from the compressor 12. One or more fuel nozzles 34 may be radially arranged in an end cover 36 to supply fuel to a combustion chamber 38 downstream from the fuel nozzles 34. Possible fuels include, for example, one or more of blast furnace gas, coke oven gas, natural gas, vaporized liquefied natural gas (LNG), hydrogen, and propane. The compressed working fluid 22 may flow from the compressor discharge plenum 30 along the outside of the combustion chamber 38 before reaching the end cover 36 and reversing direction to flow through the fuel nozzles 34 to mix with the fuel. The mixture of fuel and compressed working fluid 22 flows into the combustion chamber 38 where it ignites to generate combustion gases having a high temperature and pressure. The combustion gases flow through a transition piece 40 to the turbine 16.

The turbine 16 may include alternating stages of stators 42 and rotating buckets 44. The first stage of stators 42 redirects and focuses the combustion gases onto the first stage of rotating buckets 44. As the combustion gases pass over the first stage of rotating buckets 44, the combustion gases expand, causing the rotating buckets 44 and rotor 18 to rotate. The combustion gases then flow to the next stage of stators 42 which redirects the combustion gases to the next stage of rotating buckets 44, and the process repeats for the following stages.

Figure 2:
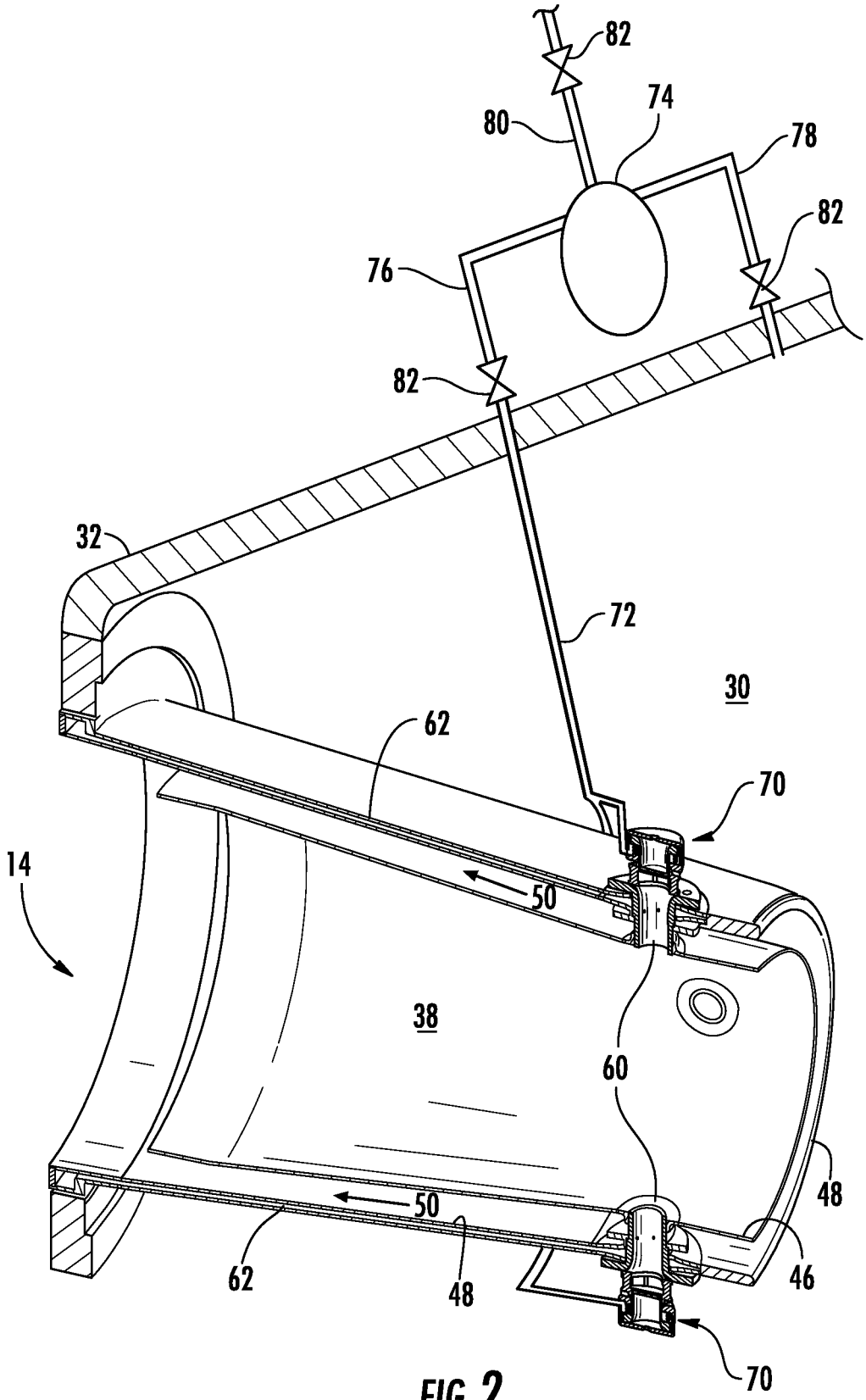
FIG. 2 is a simplified side perspective view of a portion of the combustor shown in FIG. 1 according to a first embodiment of the present invention.

FIG. 2 provides a simplified perspective view of a portion of the combustor 14 shown in FIG. 1. As shown, the combustor 14 may include a liner 46 that circumferentially surrounds at least a portion of the combustion chamber 38. A flow sleeve 48 may circumferentially surround at least a portion of the liner 46 to define an annular passage 50 that surrounds the liner 46. In this manner, the compressed working fluid 22 from the compressor discharge plenum 30 may flow through the annular passage 50 along the outside of the liner 46 to provide convective cooling to the liner 46 before reversing direction to flow through the fuel nozzles 34 (shown in FIG. 1) and into the combustion chamber 38.

The combustor 14 may further include a plurality of tubes or injectors 60 that may provide a late lean injection of fuel and working fluid 22 into the combustion chamber 38. The injectors 60 may be circumferentially arranged around the combustion chamber 38, liner 46, and flow sleeve 48 downstream from the fuel nozzles 34 to provide fluid communication for at least a portion of the working fluid 22 to flow through the flow sleeve 48 and the liner 46 and into the combustion chamber 38. As shown in FIG. 2, the flow sleeve 48 may include an internal fuel passage 62, and each injector 60 may include one or more fuel ports 64 circumferentially arranged around the injector 60. The internal fuel passage 62 may supply the same or a different fuel to the fuel ports 64 than is supplied to the fuel nozzles 34. The fuel ports 64 may thus provide fluid communication for the fuel to flow into the injectors 60 to allow the fuel and working fluid 22 to mix while flowing through the injectors 60 and into the combustion chamber 38. In this manner, the injectors 60 may supply a lean mixture of fuel and working fluid 22 for additional combustion to raise the temperature, and thus the efficiency, of the combustor 14.

One or more of the injectors 60 may include a valve 70 upstream from the injector 60 to permit, prevent, and/or throttle the amount of working fluid 22 that may flow through the injector 60. The valve 70 may be any type of valve known to one of ordinary skill in the art for permitting, preventing, and/or throttling fluid flow. For example, the valve 70 may be a globe valve, a butterfly valve, a gate valve, a throttle valve, or other suitable type of valve. As shown in FIG. 2, means for positioning the valve 70 may be operably connected to each valve 70. The structure for positioning the valve 70 may include any hydraulic, pneumatic, or mechanical linkage known to one of ordinary skill in the art for positioning valves. For example, a geared assembly may penetrate through the combustor casing 32 to connect to each valve 70 to allow manual or automated operation of each valve 70. Alternately, as shown in the particular embodiment illustrated in FIG. 2, the means for positioning the valve 70 may include a fluid plenum or pipe 72 operably connected to each valve 70 to supply fluid pressure to the valve 70. In this manner, the fluid pressure supplied by the pipe 72 may create a differential pressure across portions of the valve 70 to reposition the valve 70 between a first position that permits working fluid 22 flow to the injector 60 and a second position that prevents working fluid 22 flow to the injector 60.

The plenum or pipe 72 may circumferentially surround the flow sleeve 48 to connect to each valve 70 circumferentially arranged around the flow sleeve 48 before passing through the combustor casing 32. Once outside the combustor casing 32, the plenum or pipe 72 may receive fluid pressure from any of several possible sources. For example, as shown in FIG. 2, the plenum or pipe 72 may connect to a fluid accumulator 74 outside of the combustor 14. A first fluid connection 76 between the fluid accumulator 74 and the valve 70 may provide fluid communication between the fluid accumulator 74 and the valve 70. A second fluid connection 78 between the fluid accumulator 74 and the compressor discharge plenum 30 may provide fluid communication between the fluid accumulator 74 and inside the combustor 14. In this manner, the compressed working fluid 22 flowing through the compressor discharge plenum 30 may supply the fluid pressure to the fluid accumulator 74, and in turn to the plenum or pipe 72, to operate the valve 70, thereby reducing the chance of introducing undesirable foreign materials or fluids into the compressor discharge plenum 30 and/or the combustion chamber 38. As further shown in FIG. 2, a third fluid connection 80 to the fluid accumulator 74 may provide an additional source of fluid pressure to the fluid accumulator 74. In any event, isolation valves 82 associated with each fluid connection may allow a desired fluid pressure to be applied through the plenum or pipe 72 to each valve 70.

Figure 3:
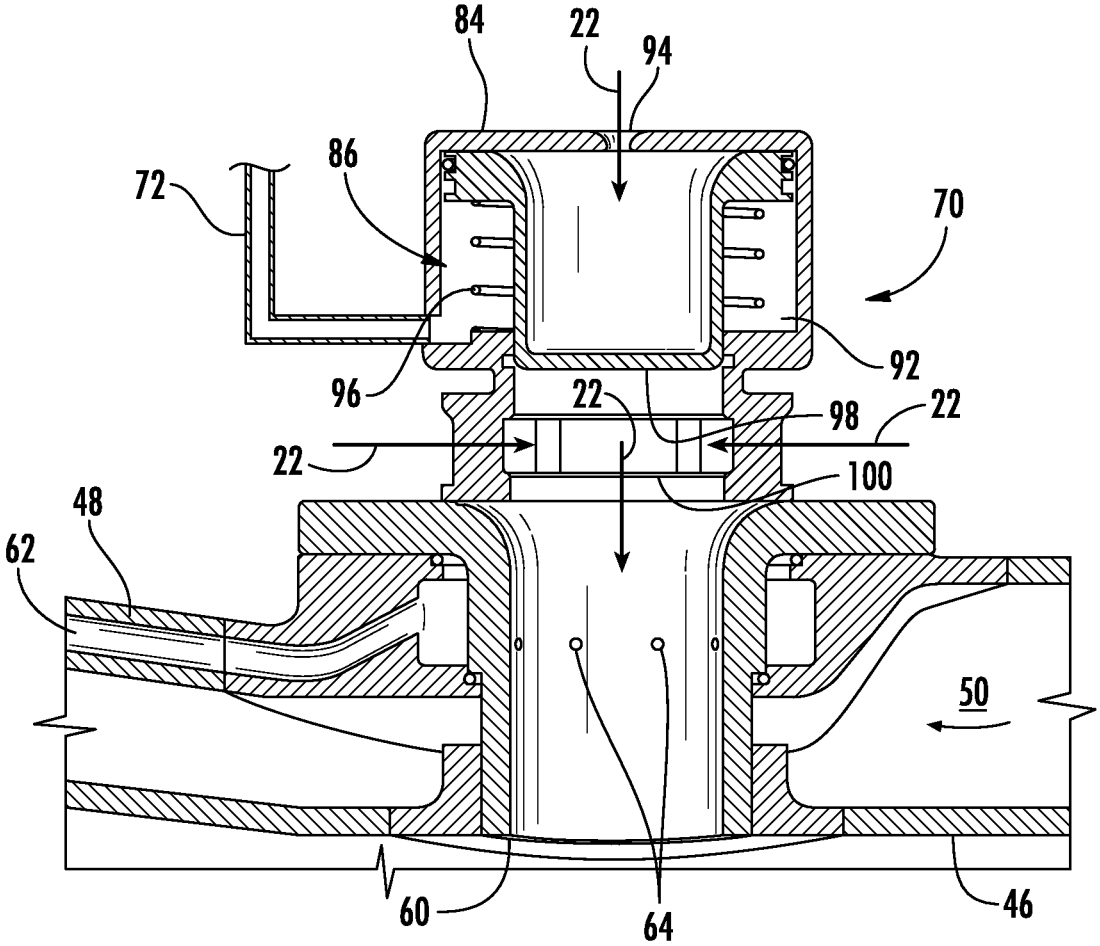
FIG. 3 is a side cross-section view of the injector shown in FIG. 2 supplying working fluid to the combustion chamber.
Figure 4:
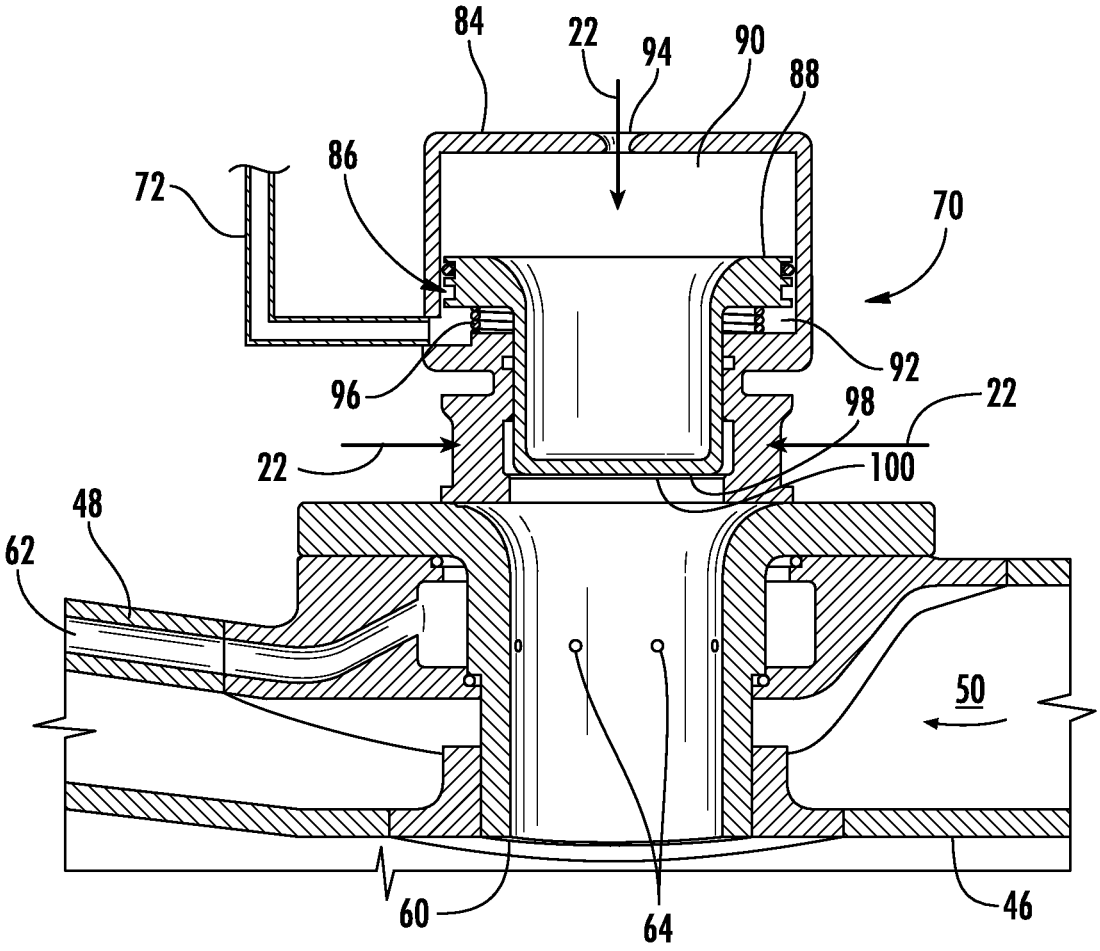
FIG. 4 is a side cross-section view of the injector shown in FIG. 2 preventing working fluid flow to the combustion chamber.

FIGS. 3 and 4 provide side cross-section views of the injector 60 shown in FIG. 2 in the first and second positions, respectively. As shown in FIGS. 3 and 4, the valve 70 may be attached or connected to the injector 60 to alternately permit or prevent fluid flow into the injector 60. In the particular embodiment shown in FIGS. 3 and 4, the valve 70 includes a valve body 84 that defines a chamber 86, and a piston 88 inside the chamber 86 separates the chamber 86 into an upper portion 90 and a lower portion 92. The upper portion 90 of the chamber 86 includes a vent hole 94 to allow the fluid pressure of the compressor discharge plenum 30 to be applied to the top of the piston 88. The plenum or pipe 72 connects to the lower portion 92 of the chamber 86 to allow the fluid pressure from the fluid accumulator 74 to be applied to the bottom of the piston 88. The differential pressure between the top and bottom of the piston 88 thus provides the means for positioning the valve 70 between the first and second positions. In addition, the valve 70 may further include a spring 96 or other device known to one of ordinary skill in the art to bias the valve 70 in either the first or second position.

As shown in FIG. 3, when the fluid pressure in the pipe 72 and the force applied by the spring 96 exceeds the fluid pressure applied through the vent hole 94, the piston 88 moves upward. A disc 98 connected to the piston 88 in turn moves upward away from a seat 100 formed by the valve body 84 and/or the injector 60. In this first position, the working fluid 22 from the compressor discharge plenum 30 may flow into and through the injector 60 and into the combustion chamber 38. The working fluid 22 flowing through the injector 60 may provide dilution and/or quenching to the combustion gases produced in the combustion chamber 38 and flowing through the transition piece 40 to the turbine 16. In addition, fuel supplied through the fuel passage 62 and fuel ports 64 into the injector 60 may mix with the working fluid 22 before being injected into the combustion chamber 38 for additional combustion to raise the combustion gas temperature and increase the thermodynamic efficiency of the combustor 14.

In FIG. 4, the fluid pressure in the pipe 72 and the force applied by the spring 96 is less than the fluid pressure applied through the vent hole 94, causing the piston 88 to move downward. As a result, the disc 98 connected to the piston 88 moves downward and engages with the seat 100 formed by the valve body 84 and/or the injector 60. In this second position, the working fluid 22 from the compressor discharge plenum 30 bypasses the injectors 60 and flows toward the end cover 36 and fuel valves 34. The additional working fluid 22 flowing through the fuel valves 34 may provide additional margin against flame holding and/or provide additional mixing and dilution for liquid fuel combustion. One of ordinary skill in the art can readily appreciate from the teachings herein that the valves 70 shown in FIGS. 2-4 may be operated in unison or independently at any position between the first position shown in FIG. 3 and the second position shown in FIG. 4. As a result, the valves 70 may be positioned to achieve a desired fuel to air ratio through each injector 60 to provide optimum emissions performance at all operating levels of the combustor 14.

Figure 5:
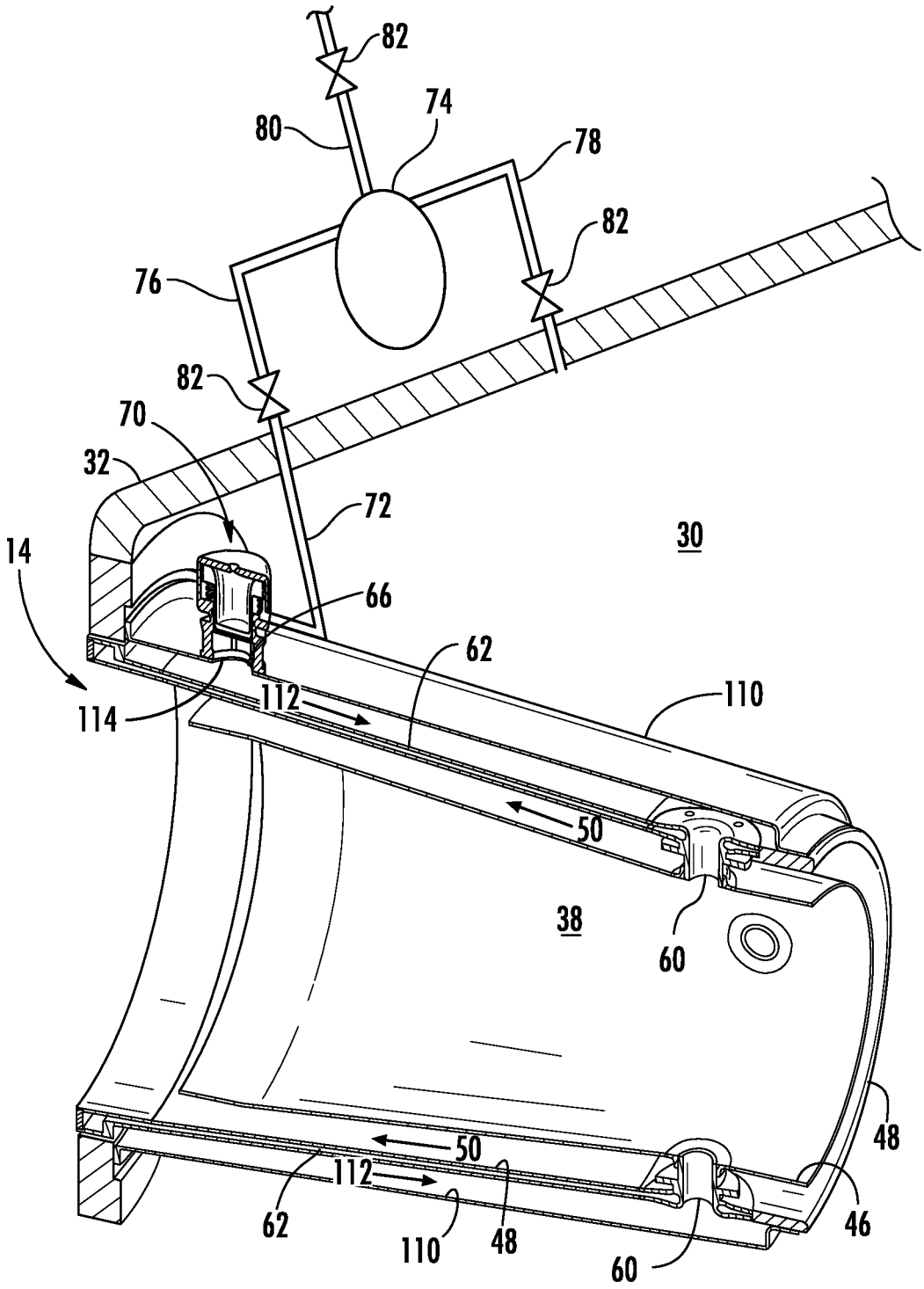
FIG. 5 is a simplified side perspective view of a portion of the combustor shown in FIG. 1 according to a second embodiment of the present invention.

FIG. 5 provides a simplified side perspective view of a portion of the combustor 14 shown in FIG. 1 according to a second embodiment of the present invention. The combustor 14 again includes the liner 46, sleeve 48, annular passage 50, injectors 60, fuel passage 62, and fuel ports 64 as previously described with respect to the embodiment shown in FIGS. 2-4. In addition, a distribution manifold 110 circumferentially surrounds the injectors 60 to shield the injectors 60 from direct impingement by the compressed working fluid 22 flowing out of the compressor 12. The distribution manifold 110 may be press fit or otherwise connected to the combustor casing 32 and/or around a circumference of the flow sleeve 48 to provide a substantially enclosed volume or annular plenum 112 between the distribution manifold 110 and the flow sleeve 48. The distribution manifold 110 may extend axially along a portion or the entire length of the flow sleeve 48. In the particular embodiment shown in FIG. 5, for example, the distribution manifold 110 extends axially along the entire length of the flow sleeve 48 so that the distribution manifold 110 is substantially coextensive with the flow sleeve 48.

One or more fluid passages 114 through the distribution manifold 110 may provide fluid communication through the distribution manifold 110 to the annular plenum 112 between the distribution manifold 110 and the flow sleeve 48. A portion of the compressed working fluid 22 may thus be diverted or flow through the fluid passages 114 and into the annular plenum 112. As the compressed working fluid 22 flows around the flow sleeve 48 inside the annular plenum 112, variations in the pressure and/or flow rate of the working fluid 22 reaching the injectors 60 are reduced to produce a more uniform fuel-air mixture injected into the combustion chamber 38.

The embodiment shown in FIG. 5 may further include the valve 70 and means for positioning the valve 70 as previously described with respect to FIGS. 2-4. The valve 70 may be attached or connected upstream from the fluid passage 114 in the distribution manifold 110 to permit, prevent, and/or throttle the amount of working fluid 22 that may flow through the fluid passage 114, annular plenum 112, and injectors 60. In this manner, a single valve 70 may control the working fluid 22 flow through multiple injectors 60 surrounded by the distribution manifold 110. In addition, the single valve 70 may reduce the amount of pipe 72 or other means needed to position multiple valves 70 circumferentially arranged around the flow sleeve 48.

The systems shown and described with respect to FIGS. 1-5 may also provide a method for supplying the working fluid 22 to the combustor 14. The method may include flowing the working fluid 22 from the compressor 12 through the combustion chamber 38, diverting or flowing a portion of the working fluid 22 through one or more injectors 60 circumferentially arranged around the combustion chamber 38, and operating the valve 70 upstream from the injectors to control the working fluid 22 flow through the injectors 60. In particular embodiments, the method may further include biasing the valve 70 to a particular position and/or supplying a control pressure from outside of the combustor 14 to the valve 70 to operate the valve 70. Alternately or in addition, the method may include distributing the diverted portion of the working fluid 22 substantially evenly around the combustion chamber 38.

The various embodiments of the present invention may provide one or more technical advantages over existing late lean injection systems. For example, the systems and methods described herein may be used to adjust the amount of working fluid 22 diverted through the injectors 60 during liquid fuel operations and/or to reduce the flame holding conditions proximate to the fuel nozzles 34. In addition, the embodiments described herein may be used to fine tune the working fluid 22 flow through the injectors 60 to reduce variations in the pressure and/or flow of the working fluid 22 through each injector 60.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supplying a working fluid to a combustor, comprising:

a liner, wherein the liner at least partially defines a combustion chamber within the combustor;

a flow sleeve that circumferentially surrounds the liner, wherein the flow sleeve and the liner define an annular passage therebetween;

a plurality of injectors circumferentially arranged around and extending through the flow sleeve and the liner, each injector having a plurality of fuel ports in fluid communication with a fuel passage, wherein the plurality of injectors provide for fluid communication of a compressed working fluid and a fuel into the combustion chamber; and a valve having a valve body connected to one injector of the plurality of injectors, wherein the valve includes a piston disposed within a chamber defined within the valve body, wherein in a first position the piston permits the compressed working fluid to flow into the one injector and in a second position the piston prevents flow of the compressed working fluid into the one injector.

2. The system as in claim 1, wherein the piston fluidly separates the chamber into an upper portion and a lower portion, wherein the upper portion is in fluid communication with a compressor discharge plenum via a vent hole defined by the valve body and the lower portion is in fluid communication with a fluid accumulator.

3. The system as in claim 2, wherein the fluid accumulator is disposed outside of a combustor casing that at least partially surrounds the combustor.

4. The system as in claim 2, further comprising a first fluid connection between the fluid accumulator and the valve and a second fluid connection between the fluid accumulator and the compressor discharge plenum.

5. The system as in claim 1, wherein the valve further comprises a spring disposed within the chamber, wherein the spring extends radially between a portion of the valve body and the piston, wherein the spring biases the piston towards the first position.

6. The system as in claim 1, wherein the piston includes a disc, wherein the disc is seated against a seat defined within the valve body when the valve is in the second position.

7. A method for supplying a working fluid to a combustor, comprising:

pressurizing a lower portion of a chamber defined within a valve body connected to an injector, wherein the lower portion of the chamber is pressurized via a fluid supplied by a fluid accumulator, wherein the fluid biases a piston within the valve body chamber towards a first position, wherein in the first position the piston permits a flow of a compressed working fluid from a compressor discharge plenum to flow into the injector;

wherein the injector includes a plurality of fuel ports in fluid communication with a fuel passage, wherein the injector provides for fluid communication of the flow of the compressed working fluid and a flow of a fuel into a combustion chamber of the combustor.

8. The method as in claim 7, further comprising pressurizing an upper portion of the chamber via the compressed working fluid from the compressor discharge plenum, wherein the compressed working fluid biases the piston within the valve body chamber towards a second position, wherein in the second position the piston restricts the compressed working fluid flowing into the injector.

9. The method as in claim 7, wherein the fluid accumulator is disposed outside of a combustor casing that at least partially surrounds the combustor.

10. The method as in claim 7, further comprising controlling the pressure of the fluid from the fluid accumulator into the lower portion of the chamber to increase or decrease the flow of the compressed working fluid into the injector.

11. The method as in claim 7, further comprising injecting the fuel into the flow of the compressed working fluid.

* * * * *